United States Patent [19]

Thorpe

[11] Patent Number: 4,721,208

[45] Date of Patent: Jan. 26, 1988

[54] RAZOR DISPLAY PACKAGE

[75] Inventor: Donald Thorpe, Madison, Conn.

[73] Assignee: Warner-Lambert Company, Morris Plains, N.J.

[21] Appl. No.: 3,963

[22] Filed: Jan. 16, 1987

[51] Int. Cl.[4] ..... B65D 73/00

[52] U.S. Cl. ..... 206/353; 206/463; 206/485

[58] Field of Search ..... 30/85, 86, 90; 206/44.12, 349, 352–356, 372, 461–471, 476, 485, 486–488

[56] References Cited

U.S. PATENT DOCUMENTS

| | | | |
|---|---|---|---|
| 3,064,402 | 11/1962 | Crane, Jr. | 206/463 |
| 3,970,194 | 7/1976 | Iten | 206/469 |
| 4,266,664 | 5/1981 | Dixon et al. | 206/349 |
| 4,322,002 | 3/1982 | Iten | 206/349 |
| 4,341,306 | 7/1982 | Lightsey | 206/44.12 |
| 4,432,452 | 2/1984 | Kelly | 206/349 |
| 4,445,610 | 5/1984 | Richards | 206/349 |
| 4,496,047 | 1/1985 | Gatley | 206/471 |

*Primary Examiner*—Jimmy G. Foster

*Attorney, Agent, or Firm*—Howard Olevsky; Stephen Raines

[57] ABSTRACT

According to this invention a razor pack adapted to hold a plurality of razors of substantially identical configuration has a plastic sleeve, which is formed to cover aligned razor heads, the sides of the heads, and a portion of the bottom of the razor. The individual razor units are inserted in the sleeve and the sleeve is attached to a card having a raised rear portion forming an abutment for the back of the sleeve and a closed front portion forming a stop for the razor handles.

5 Claims, 3 Drawing Figures

RAZOR DISPLAY PACKAGE

FIELD OF INVENTION

This invention relates to a package for disposable razors and particularly to a package having mounting means for display purposes.

BACKGROUND OF THE INVENTION PACKS

Disposable razors are usually sold in card containers which provide means for holding a plurality of razors as well as mounting means. Disposable razors are configured along separate axes which are normal to each other. This means that a package must be designed to accommodate a plurality of razor heads which is generally at right angles from the handle.

U.S. Pat. No. 4,266,664 issued May 12, 1981 to Roy P. Dixon et al describes a typical disposable razor pack having a card which surrounds a major proportion of the handles of the multiple razor pack and has an opening for receiving the razor heads. In this instance, a cut is made in the card near the top portion which is then folded upward to provide a covering for the razor head. While the design is simple and inexpensive, only the top of the razor head is covered with the sides being exposed. As a result, each individual razor must have a separate cap which at least protects the blade surface from being gouged during transit and from inadvertently cutting the user. These separate caps can be easily dislodged and must be precisely manufactured to provide a sufficient barrier from extraneous dirt which may infiltrate the space remaining between the individual cap and razor.

When lubricating strips, such as disclosed in U.S. Pat. No. 4,170,821 are added to caps of disposable razors it is necessary to provide a barrier to moisture to prevent these strips from becoming prematurely tacky. Since the strips are made of relatively soft material they can be easily gouged and tight fitting caps which would provide a suitable moisture barrier would not be otherwise suitable for protecting the strip, because of the likelihood of gouging from the mating operation. The use of the package disclosed in the Dixon Patent, even if individual caps are present for the individual razors, does not, provide a moisture barrier and becomes less than ideal, therefore, when a lubricating strip is added to the cap of a disposable razor.

A similar razor pack is disposed in U.S. Pat. No. 4,341,306 issued July 27, 1982 to Martin E. Lightsey wherein separate card flaps are used to protect oppositely positioned groups of razor heads. The opposite positioning, according to the invention, allows for hanging from a centrally positioned hole with the card in balance.

U.S. Pat. No. 4,496,047 issued to Derrick R. Gatley on Jan. 29, 1985 discloses a razor card pack in which the handles of the razor are characterized by a slot positioned on the upper portion thereof a tongue of the card pack extends into the groove thereby positioning all of the individual razors by butting the handles. This patent also discloses the concept of a plastic sleeve positioned completely around all of the razor heads. The razors are positioned inward so that the cards extends beyond both ends of the plastic sleeves.

U.S. Pat. No. Des. 282,242 issued Jan. 21, 1986 in my name, depicts a card for disposable razors in which the individual razor heads have covers with each of the razors being separated by these covers, in an open area totally enclosed within a card segment at both ends as well as the top and bottom. My design patent differs from the Gatley Patent in that, among other features, the card surrounds a portion of the handles of the razor with another portion extending beyond the edge of the card, while the Gately pack extends along most of the length of the razor with the bottom of the razors terminating approximately at the bottom of the card itself. Each of these configurations has disadvantages associated either protection of the cap, cost, or difficulty of assembly.

Other relevant patents, which relate to card packaging or to multiple disposable razor packaging, but are believed the less relevant to the subject invention than those discussed above or U.S. Pat. No. 2,974,782 issued Mar. 14, 1961 to E. H. Walter; U.S. Pat. No. 4,432,452 issued Feb. 21, 1984 to John F. Kelly; U.S. Pat. No. 4,601,392 issued July 22, 1986 Wolfgang Althaeus; U.S. Pat. No. 4,450,980 issued to M. L. Clabby on May 29, 1984; U.S. Pat. No. 4,322,002 issued Mar. 30, 1982 to Clemens A. Iten; and the U.S. Pat. No. 4,166,533 issued Sept. 4, 1979 to Robert L. Maitland.

SUMMARY OF THE INVENTION

According to this invention a razor pack adapted to hold a plurality of razors of substantially identical configuration has a plastic sleeve, which is formed to cover aligned razor heads, the sides of the heads, and a portion of the bottom of the razor. The individual razor units are inserted in the sleeve and the sleeve is attached to a card having a raised rear portion forming an abutment for the back of the sleeve and a closed front portion forming a stop for the razor handles.

DETAILED DESCRIPTION OF THE INVENTION AND DRAWINGS

The invention can be better understood by reference to the drawings in which.

Figure 1:
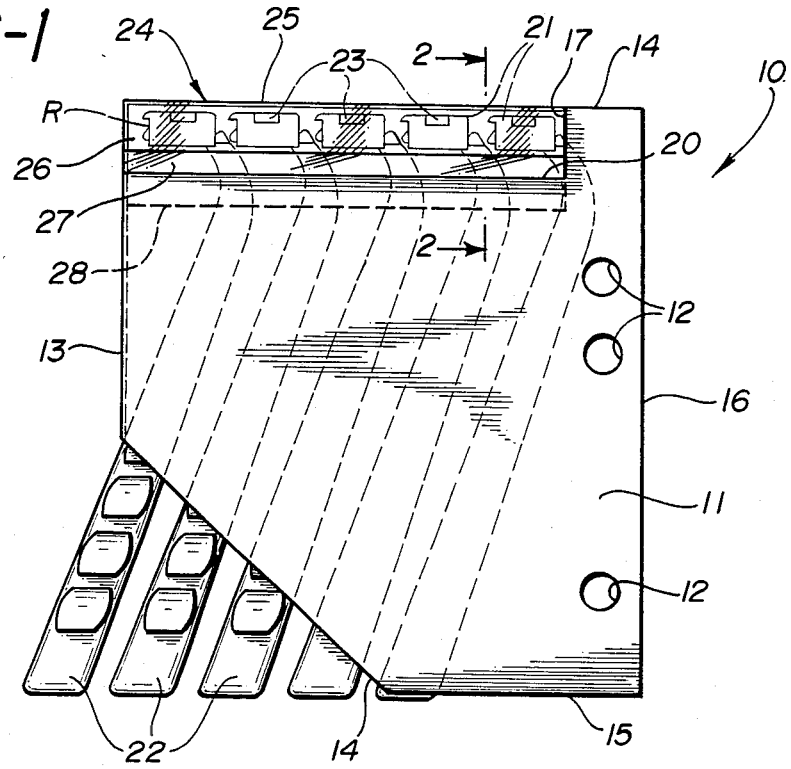
FIG. 1 is a side view of the razor pack of this invention with razors included.

As can be seen from the Figs., particularly FIG. 1, a series of razors are shown positioned within the razor pack 10. As can be seen, particularly with reference to FIGS. 1 and 2, the razors R have handles 22 depending downward from cap 21 and include a lubricating strip insert 23. Both the cap top with the lubricating insert 23 and the cap side are visible in the transparent plastic sleeve 24.

The card portion of the razor pack includes both front portion 13 and a rear portion 16, mounting holes 12 for attachment of the pack to peg board hook displays or the like, a top portion 14 which is in the form of a shoulder terminating at the top axis of the plastic cover 24, side surfaces 11 and 18 (FIG. 2) and ledge 20.

Figure 2:
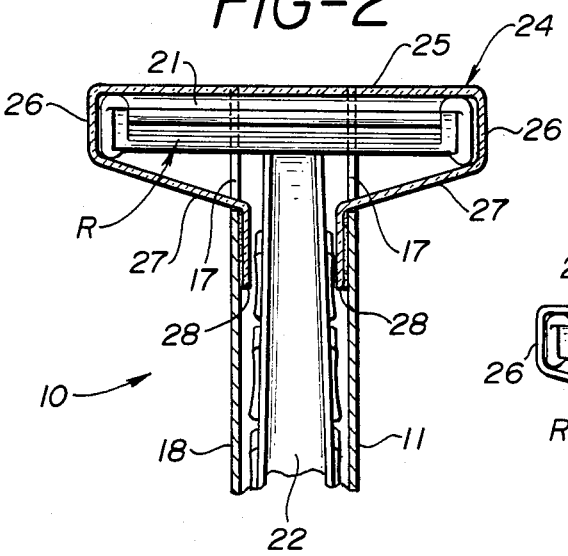
FIG. 2 is a partial cross sectional view of the pack shown along lines 2—2 of FIG. 1.
Figure 3:
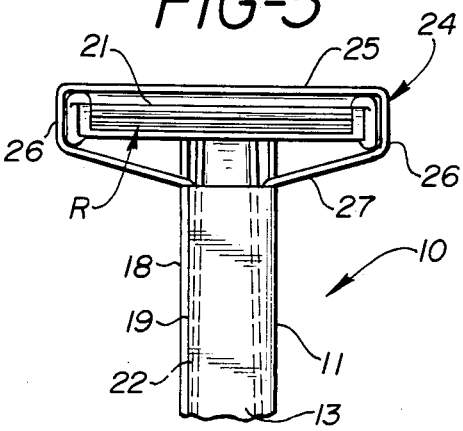
FIG. 3 is a partial front-end view of the razor pack according to FIG. 1.

As shown in FIG. 2, the transparent thermoplastic plastic sleeve 24 has top element 25, sides 26 and bottom elements 27 which include downwardly sloping surfaces 27 terminating in essentially parallel flanges 28 which are adhesively attached to the inner surface of sides 11 and 18 respectively of the card. The razors R are mounted so that they rest upon the bottom shoulder 27 of the plastic sleeve 24. The plastic sleeve 24 is supported by ledge 20 extending from the front 13 of the card back toward shoulder 14. As can best be seen by reference to FIG. 2, shoulder 14 produces a stop surface 17 for aligning the rearward most razor. The front razor is maintained in position by the front portion of the card 13. As shown particularly in FIG. 3, the card wraps around itself at the front portion and is sealed at the front 19, preferably by adhesive.

It should be noted that although the portion 27 of sleeve 24 is shown as downwardly sloping, it need not be and the bottom portion of the sleeve 24 may be essentially parallel to the top portion 25. This is dependent primarily upon the nature of the sleeve material chosen and its resilience, and the aesthetics chosen.

Once again referring to FIG. 1, the razor caps have lubricating strips 23 which are now completely protected from direct contamination by moisture or dirt due to the presence of the sleeve 24. This protection occurs by virtue of the position of the sleeve around the razor heads and avoids the need for a separate cap for each of the heads.

Currently preferred assembly methods feature the positioning of the sleeve, either in a horizontal or vertical direction and the insertion of the razors in the sleeve. The razor and sleeve combination in then mated with the card which is either preformed or shaped around the sleeve—razor combination. The sleeve flanges are adhesively sealed to the card preferrably with the flanges inside the card.

Other variations on the teachings of this invention will be apparent to those with skill in the art. Because there is no stop function performed by rear portion 16, there is no need for the card to extend around the back, therefore, the card can be made in 2 separate units with overlapping flaps in front and an open back or a single section having a wrap around back with a sealed front.

I claim:

1. A razor pack adapted to hold a plurality of razors of substantially identical configurations, each with a razor head and a handle, extending downward from said head comprising in combination:

(a) a container made of card having two facing, essentially parallel side surfaces with a bottom edge and a top edge, said top edge of each of said side surfaces forming a raised stop portion near the rear end of said side surfaces, and said plurality of razor handles extending between said side surfaces and said plurality of said razor heads extending transversely above said side surfaces; and (b) a sleeve of thermoplastic material extending frontward from and butting against said stop portion, said sleeve having a top, sides extending essentially parallelly downward from said top and essentially parallel to said card side surfaces, and a bottom portion extending inward from each side extending toward said razor handles, said bottom having downwardly extending flanges at each inward edge attached to said card side surfaces, said sleeve designed to surround said razor head top, side and at least a portion of said bottom.

2. The pack of claim 1 wherein the flanges attached the inside of said card side surfaces.

3. The pack of claims 1 or 2 wherein at least one of the card side surfaces extend normal to itself at the pack front to form a stop for the razor handles.

4. The pack of claims 1, or 2 wherein the card extends across said stop portion near the rear end of said surfaces.

5. The pack of claims 1 or 2 wherein the sleeve is transparent.

* * * * *